United States Patent [19]

Thro et al.

[11] Patent Number: 4,650,436

[45] Date of Patent: Mar. 17, 1987

[54] DEFLECTION YOKE CENTERING APPARATUS

[75] Inventors: Dennis E. Thro; Mort J. Nierenberg, both of Lancaster, Pa.

[73] Assignee: RCA Corporation, Princeton, N.J.

[21] Appl. No.: 792,787

[22] Filed: Oct. 30, 1985

[51] Int. Cl.[4] ..... H01J 9/42

[52] U.S. Cl. ..... 445/63; 29/271; 324/404; 358/10

[58] Field of Search ..... 445/3, 63; 358/10; 29/271, 272, 283, 281.5; 269/50, 52; 324/404

[56] References Cited

U.S. PATENT DOCUMENTS

| | | | |
|---|---|---|---|
| D. 239,832 | 5/1976 | Puhak | D26/1 D |
| 3,553,810 | 1/1971 | D'Aquin | 29/281.5 |
| 3,617,871 | 11/1971 | Rogus | 324/404 |
| 3,786,185 | 1/1974 | Shrader | 178/7.8 |
| 3,844,006 | 10/1974 | McGlashan | 445/36 |
| 3,906,607 | 9/1975 | Gusev | 29/281.5 |
| 3,950,720 | 4/1976 | Shrader | 335/210 |
| 4,163,308 | 8/1979 | Tawa et al. | 445/3 |
| 4,360,839 | 11/1982 | Ragland | 335/212 |
| 4,405,950 | 9/1983 | Wardell | 445/3 |

*Primary Examiner*—Kenneth J. Ramsey

*Attorney, Agent, or Firm*—E. M. Whitacre; D. H. Irlbeck; L. L. Hallacher

[57] ABSTRACT

An apparatus for centering a deflection yoke in a support ring includes a spindle having a tapered portion and a cylindrical portion. A spider, having radial arms, is centered on the spindle. A planar member includes an inset which is centered on the spindle, and is supported on the radial arms. The inset centers the support ring on the spindle. The tapered portion centers a yoke on the spindle whereby the yoke is centered in the support ring. Holding members are in the support ring, and hold the yoke centered in the support ring.

5 Claims, 5 Drawing Figures

DEFLECTION YOKE CENTERING APPARATUS

BACKGROUND

This invention relates generally to the production of cathode ray tubes, and particularly to an apparatus for centering a deflection yoke in a support ring for a test set.

The visual display on the screen of a cathode ray tube (CRT) is generated by scanning electron beams across the screen of the cathode ray tube. During the scanning, the electron beams are modulated with the video information required to generate the desired display. In a CRT for a color television receiver, three beams are simultaneously scanned across the screen. The electron beams are scanned horizontally across the screen from one side to the other. After a complete horizontal line is scanned, the electron beams are returned to the initial side so that all horizontal lines are scanned in the same direction. Prior to scanning the succeeding line, the electron beams are stepped vertically one line width. The horizontal scanning and vertical stepping are repeated until the full screen has been scanned by the electron beams and one frame of the display been generated.

The horizontal scanning and vertical stepping of the electron beams are affected by a magnetic deflection device, commonly called a yoke. The yoke includes both horizontal and vertical deflection coils which are biased with the appropriate voltages to cause the scanning and stepping. The horizontal deflection coils are actuated with a varying signal, such as a triangular waveform to cause the beams to scan horizontally across the tube. The vertical deflection coils are provided with vertical deflection signals which cause the beams to impact the screen at selected vertical positions in synchronization with the initiation of the horizontal scanning. It is important that the horizontal and vertical electron beam motions be parallel to the horizontal and vertical axes of the screen. The orientation of the yoke on the CRT is therefore important because the positioning of the deflection coils in the yoke determines the direction of the beam motions. One of the final steps in the manufacture of a kinescope is the testing of the tube to verify that all operating parameters are within the required specifications. This test is conducted prior to permanently placing a yoke on the kinescope. Typically, the test is done in a test set which includes a yoke and which has provisions for applying the horizontal scanning voltage and the vertical stepping voltage to the respective deflection coils of the yoke. The yoke in the test set must be of the type required for the type of tube to be tested. Accordingly, each time a different type of tube is tested, the yoke in the test set must be changed. In the past, a different yoke mounting arrangement was required for each type of tube. This requirement resulted in substantial expense in designing yoke mounting arrangements. For these reasons, there is a need for an apparatus for accurately and rapidly centering yokes for all tube types in a test set used to test cathode ray tubes. The present invention fulfills this need.

SUMMARY

An apparatus for centering hollow deflection yokes, having an annular mounting member, in a test set support ring includes a spindle having a cylindrical portion and a tapered portion which snugly receives yokes of various sizes. A spider, having a lockable hub, is slidably arranged coaxially about the cylindrical portion whereby the spider is lockable at multiple positions on the spindle to enable many sizes of yokes to snugly engage the tapered portion. The spider includes a plurality of radially extending arms, each of which includes a flat surface lying in a plane substantially normal to the spindle. Some of the flat surfaces include locating members. A planar ring positioning member has a centered aperture and an inset around the aperture. The inside diameter of the inset is substantially equal to the outside diameter of the support ring whereby the inset centers the support ring on the planar ring positioning member. The planar ring positioning member also includes additional locating means configured and dimensioned to mate with the locating members of the flat surfaces whereby the planar ring positioning member is centered on the spindle. The support ring includes a plurality of yoke holding members which hold the yoke centered relative to the spindle.

DETAILED DESCRIPTION

Figure 1:
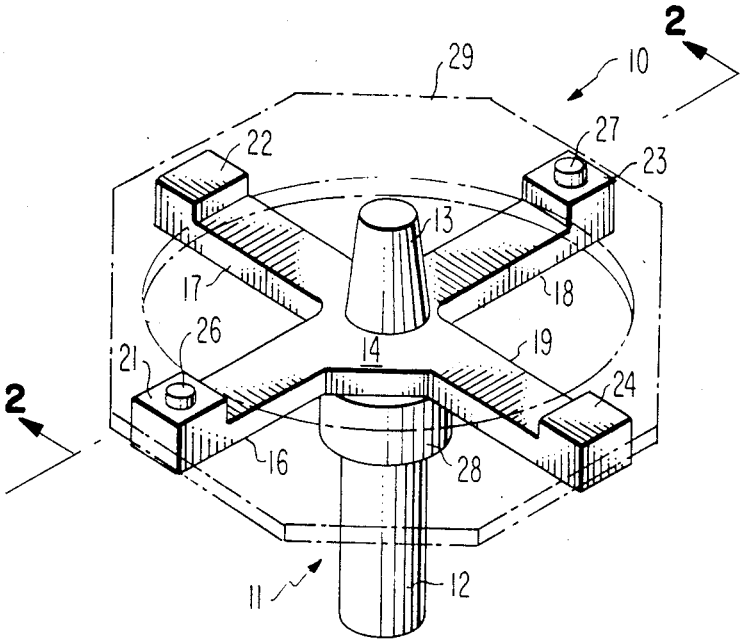
FIG. 1 is an isometric view showing a centering spindle and a spider which are included in a preferred embodiment.
Figure 2:
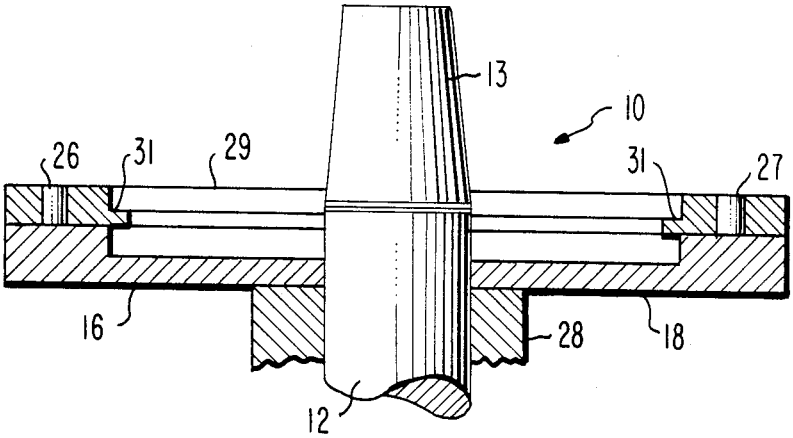
FIG. 2 is a cross section taken along line 2—2 of FIG. 1.

In FIGS. 1 and 2, the inventive yoke centering apparatus 10 includes a spindle 11 having a cylindrical portion 12 and a tapered portion 13. A spider 14 is coaxially arranged about the cylindrical portion 12. The spider 14 includes arms 16, 17, 18 and 19 extending radially from and equiangularily spaced about the spindle 11. The radial arms 16 through 19 each includes a flat surface 21, 22, 23, and 24 respectively. The flat surfaces 21 to 24 all lie within a plane which is substantially perpendicular to the longitudinal axis of the spindle 11. The surfaces 21 and 23 support locating members 26 and 27, respectively, which preferably are round pins. The spider 14 is supported on a slidable and lockable hub 28. The hub 28, and thus also the spider 14, are slidable longitudinally along the cylindrical portion 12 so that the position of the spider 14 with respect to the tapered portion 13 is adjustable. The hub 28 is lockable at any position on the cylindrical portion 12, and is a known, commercially available item. A planar ring positioning member 29, shown in phantom in FIG. 1 and in cross section in FIG. 2, rests on the flat surfaces 21 through 24 of the spider 14 and also extends substantially perpendicular to the longitudinal axis of the spindle 11. The planar ring positioning member 29 includes an annular inset 31.

Figure 3:
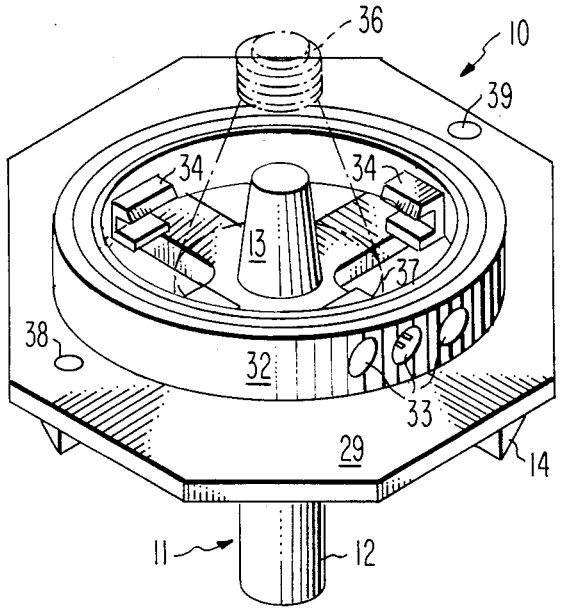
FIG. 3 is an isometric view showing the planar ring positioning member and a yoke positioned on the spindle.

In FIG. 3, a test set support ring 32 is supported by the planar ring positioning member 29 and rests within the inset 31. The outside diameter of the support ring 32 is substantially equal to the inside diameter of the offset 31 within the positioning member 29. The support ring 32 includes a plurality of circular apertures 33. The apertures 33 are used to support yoke holding members 34, shown in detail in FIGS. 4*a* and 4*b*. The ring 32 includes several sets of the apertures 33 so that the yoke holding members 34 can be positioned at various locations in accordance with the type of yoke to be supported in the apparatus 10. A hollow yoke 36, shown simplified and in phantom, is centered on the tapered portion 13 of the spindle 11. An annular mounting member 37 is permanently coupled to the yoke 36 and is coaxial about the yoke. The yoke 36, as is known to those skilled in the art, includes an internal taper which is configured and dimensioned to snugly engage the funnel shaped portion of a CRT. The tapered portion 13 of the spindle 11 is tapered and dimensioned in accordance with the various standard tapers of CRT yokes so that yokes of various sizes snugly engage the tapered portion 13. The lockable hub 28 is locked at various positions along the length of the cylindrical portion 12 in accordance with the position of the yoke 36. The planar ring positioning member 29 includes additional locating means 38 and 39, in the form of apertures, which are spaced, dimensioned and configured to snugly engage the locating pins 26 and 27 within the surfaces 21 and 23, respectively.

Figure 4A:
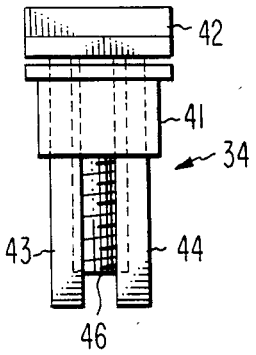
FIGS. 4*a* and 4*b*, respectively, are top and side views of preferred yoke holding members.
Figure 4B:
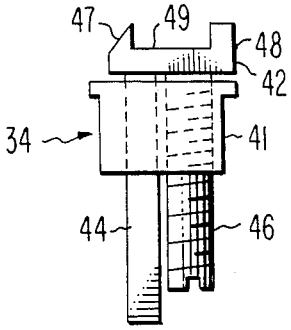

In FIGS. 4*a* and 4*b*, the yoke holding members 34 include an insert 41 configured and dimensioned to snugly fit into the apertures 33 within the support ring 32. An engagement member 42 is integral with two circular pins 43 and 44. The pins 43 and 44 pass through apertures within the insert 41 so that the engagement member 42 is slidable with respect to the insert 41. A screw 46 is threaded into the insert 41 to engage one surface of the engagement member 42. The engagement member 42 includes flanges 47 and 48, between which lies an engagement surface 49. The flanges 47 and 48 are spaced in accordance with the width of the annular mounting ring 37 of the yoke 36.

In use, the planar ring positioning member 29 is placed onto the spider 14 by mating the apertures 38 and 39 with the locating pins 26 and 27, respectively. The planar ring positioning member 29 and, accordingly the inset 31, are thus accurately centered with respect to the longitudinal axis of the spindle 11. A plurality of the yoke holding members 34 is arranged in some of the apertures 33 within the support ring 32 in accordance with the type of yoke to be centered on the device. The test set support ring 32 is placed in the inset 31 and the support ring, therefore, is also accurately centered with respect to the longitudinal axis of the spindle 11. The lockable hub 28 is loosened and the spider 14, the planar surface 29 and the support ring 32 are longitudinally slidable along the cylindrical portion 12. The yoke is placed onto the tapered portion 13 of the cylinder 11 so that the end of the yoke engages the arms 16 through 19 of the spider 14. The hub 28 along with the spider 14, the planar ring positioning member 29 and the support ring 32 are slid longitudinally along the cylinder 11 until the internal tapered hollow of the yoke 36 snugly engages the tapered portion 13 of the cylinder 11. The hub is then locked to maintain the desired position of the hub and the yoke on the cylinder. The screws 46 are then turned to push the engagement members 42 radially inwardly toward the annular mounting ring 37 until the ring lies between the flanges 47 and 48 in engagement with the engagement surface 49. The yoke 36 is then permanently centered with respect to the spindle 11 and therefore is also centered with respect to the test set support ring 32. The support ring 32 along with the centered yoke 36 are removed from the spindle 11 and planar support positioning member 29 and placed into a test set where the yoke 36 is mated with the funnel portion of a CRT. The appropriate voltages are applied to the CRT and to the yoke and the orientation of the yoke is adjusted until the horizontal and vertical motions of the beam across the CRT screen are aligned with the axes of screen. When the beam motions are properly aligned the yoke is in the desired orientation for testing.

What is claimed is:

1. An apparatus for, centering a hollow deflection yoke, having an annular mounting member, in a test set comprising:

a support ring for centering and supporting said yoke in said test set;

a spindle having a cylindrical portion and a tapered portion for snugly receiving yokes of varying size;

a spider having a lockable hub slidably arranged coaxially about said cylindrical portion whereby said spider is lockable at multiple positions on said spindle to enable many sizes of yokes to snugly engage said tapered portion, said spider including a plurality of radially extending arms, each of said arms including a flat surface lying in a plane substantially normal to said spindle, at least some of said flat surfaces including first locating means;

a planar ring positioning member having a centered aperture and an inset centered around said aperture, said inset having a diameter substantially equal to the diameter of said support ring whereby said inset centers said support ring on said planar ring positioning member, said planar ring positioning member also including additional locating means configured and dimensioned to mate with said first locating means whereby said planar ring positioning member is centered relative to said spindle;

said support ring including a plurality of yoke holding members, for holding said deflection yoke centered relative to said spindle, and relative to said support ring.

2. The apparatus of claim 1 wherein said yoke holding members are moveable radially toward said spindle, said yoke holding members including engagement means for engaging said annular mounting member, said holding members also including means for moving said engagement means radially toward said annular mounting member and for biasing said engagement means against said annular mounting member whereby said yoke is firmly supported in said support ring.

3. The apparatus of claim 2 wherein said engagement means includes an engagement surface having flanges spaced to span said annular mounting member.

4. The apparatus of claim 3 wherein said yoke holding members are slidable toward said spindle.

5. The apparatus of claim 4 wherein said means for moving is a screw whereby said engagement means are firmly held in contact with said annular mounting member.

* * * * *